US006866597B2

(12) United States Patent
Kim

(10) Patent No.: US 6,866,597 B2
(45) Date of Patent: Mar. 15, 2005

(54) RACKET STRING CORRECTION TOOL

(76) Inventor: Hyun Sik Kim, Avellaneda 3210, Buenos Aires (AR), C1406F7R ( * ) Notice: Subject to any disclaimer, the term of this patent is extended or adjusted under 35 U.S.C. 154(b) by 0 days.

(21) Appl. No.: 10/650,209

(22) Filed: Aug. 28, 2003

(65) Prior Publication Data

US 2004/0048699 A1 Mar. 11, 2004

(30) Foreign Application Priority Data

Aug. 29, 2002 (AR) ..... M020103238

(51) Int. Cl.[7] ..... A63B 49/00
(52) U.S. Cl. ..... 473/553
(58) Field of Search ..... 473/553, 557; 7/106; 66/118; D21/729, 799.1

(56) References Cited

U.S. PATENT DOCUMENTS 1,788,656 A * 1/1931 Brown ..... 7/106
2,152,879 A * 4/1939 Dorsey ..... 43/53.5
2,434,550 A * 1/1948 Daniel ..... 43/53.5
D200,582 S * 3/1965 Klompus et al. ..... D22/149
4,752,071 A * 6/1988 Tabach ..... 473/553
5,035,429 A * 7/1991 Redrow ..... 473/553
5,653,441 A * 8/1997 Woltanski ..... 473/553
6,692,387 B2 * 2/2004 Berens et al. ..... 473/553
2004/0048699 A1 * 3/2004 Kim ..... 473/553

* cited by examiner

*Primary Examiner*—Raleigh W. Chiu
(74) *Attorney, Agent, or Firm*—Snell & Wilmer L.L.P.

(57) ABSTRACT

A tool for adjusting string on a racket is disclosed. The tool is comprised of a longitudinal body comparable in size to that of a pen, defined by a hilt with a distal section that narrows at the end, which is provided with a notch to push the string transversally and a hook to pull it and correct displacements in the set of strings' octagonal configuration. At the proximal end, the tool comprises a notch that houses, and protects, a cutting edge, which may produce the necessary cuts in the string to avoid racket bending. The invention is a multi-function instrument that may be easily carried by the player, to be used instead of the usual means that include pushing levers and cutting edges or scissors.

5 Claims, 2 Drawing Sheets

RACKET STRING CORRECTION TOOL

CROSS REFERENCE TO RELATED APPLICATIONS

This application claims priority to Argentina Utility Model Serial No. M 02 01 03238 filed on Aug. 29, 2002.

FIELD OF INVENTION

The present invention generally relates to a tool for adjusting racket strings. More particularly, the invention relates to a racket string correction tool configured to adjust a string transversally. The tool includes a hook and a notch to respectively pull or push the racket string and correct string displacements. The tool also encompasses a cutting edge suitable for cutting the racket string to correct string tension.

BACKGROUND OF THE INVENTION

In practice, the correct tension of a filamentous element (e.g. racket string) passing in a zig-zag fashion through oval frame holes is considered very important to allow a player, when hitting a ball, such as a tennis ball, to direct the ball at a desired speed. The shot effect and direction are achieved by the player's ability, the correct string tension, and the configuration of grid squares (grate) formed by the interwoven racket strings.

During play, collisions between the ball and the racket strings often cause displacement of some sections of the strings and alter the grate configuration. An altered grate configuration acts as a tempered patch and produces an imbalance that impairs shot quality. It is for this reason that we often see players making great efforts to correct such defects with their fingers.

Another difficulty, typical of a racket sport, is observed when there is a cut in a non-central point of the string. The string's tension is essentially maintained due to frictional adjustment against the racket frame threading holes and crossings, but when there is a cut section, a tempering imbalance may occur that may bend the racket. Such bending may be temporarily corrected by making a compensating cut made at a certain, counter balancing point of the grate.

According to previous rules of the art, in order to solve the above-mentioned problems without stopping play or replacing the racket, tennis players require a lever at hand to correct the string displacement referred in the above former case, as well as a pair of scissors or a cutting element to solve the imbalance referred to in the above latter case. Obviously, the danger posed by such elements prevents tennis players from carrying such items to the tennis court.

SUMMARY OF THE INVENTION

This invention provides a tool capable of allowing for the immediate correction of racket string deformations and/or making the necessary cuts to balance partial tension losses.

In accordance with one embodiment of the invention, the tool includes a longitudinal instrument whose size may be comparable to that of a pen. The tool includes a handle portion or hilt, with non-slipping grooves that cover the largest portion of the tool, which is axially interposed between an actuating point in a string transversal displacement portion and a cutting point.

In accordance with one aspect of the embodiment, the transversal section of the tool is gradually reduced from one end of the tool to the other, and the section finishes off, at the free end, with a substantially semi-circular point between two flat faces that, from the hilt, forms a decreasing wedge.

In accordance with a further aspect of the invention, an arc of the semicircular point presents a transversal notch with reference to the above-mentioned wedged faces, capable of adjusting the string, and a side appendage that incorporates a parallel opened hook, on the side opposite the above-mentioned notch, wherein the hook resembles a crochet needle.

At the opposite end, the hilt decreases and defines, axially, a half-ellipsoid with a notch at its point that houses the cutting edge of a blade, transversally oriented towards an opening, which is built into the tool and provides no external dangerous exposure.

Hence, when the grid square has been altered, the player, holding the tool by the handle portion, will introduce the actuating point to expand the grid square with a pushing force entering from the wedged tool structure, up to the depth necessary for the transversal pushing force to produce a satisfactory adjustment.

Whenever string displacement requires a greater sliding effort to overcome the interwoven string forces, an axial pushing force may be exercised on the string, wedged in the notch, or else the hook may be used to pull the string back into the correct position.

When an accidental cut of a string causes a tension imbalance, introducing the string into the cutting notch and pushing it axially until it is cut by the cutting edge may resolve the imbalance.

BRIEF DESCRIPTION OF THE DRAWINGS

A more complete understanding of the present invention may be derived by referring to the detailed description and claims, considered in connection with the figures, wherein like reference numbers refer to similar elements throughout the figures.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

In order to define the above-mentioned advantages and facilitate the understanding of the constructive and functional characteristics of the invented racket string correction tool, there follows a description of an embodiment of the invention that is not intended to limit the scope of the claims. Rather, various changes may be made in the function and arrangement of the elements described herein without departing from the spirit and scope of the invention.

Figure 1:
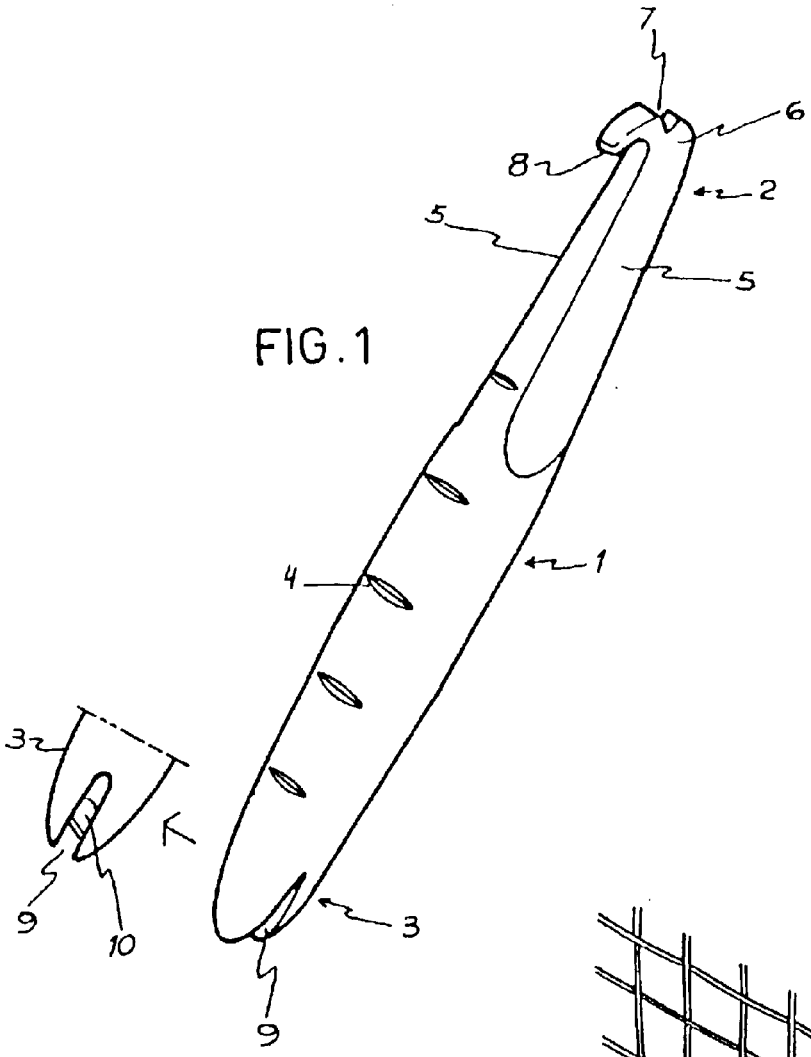
FIG. 1 is a perspective view of a tool in accordance with one embodiment of the invention.

As it may be observed in FIG. 1, a tool in accordance with one embodiment of the invention includes a handle portion or hilt -1- with an actuating point -2- and a cutting point -3-.

Hilt -1- includes adequate thickness to be held by a player and hilt -1- is provided with non-slipping grooves -4- whose thickness decreases axially on a portion of hilt -1-. Actuating point -2- provides a wedge between two lateral faces -5- that meet at a point -6-. Point -6- ends in a substantially semi-circle shape, with an end notch -7- and also incorporates a hook -8- on its side.

With continuing reference to FIG. 1, from the cutting point side of hilt -1-, there is an ellipsoidal structure that defines a cutting point -3-, which is provided with a V-shaped notch -9- at the end with a cutting blade -10- inside, oriented towards an outlet.

Figure 2:
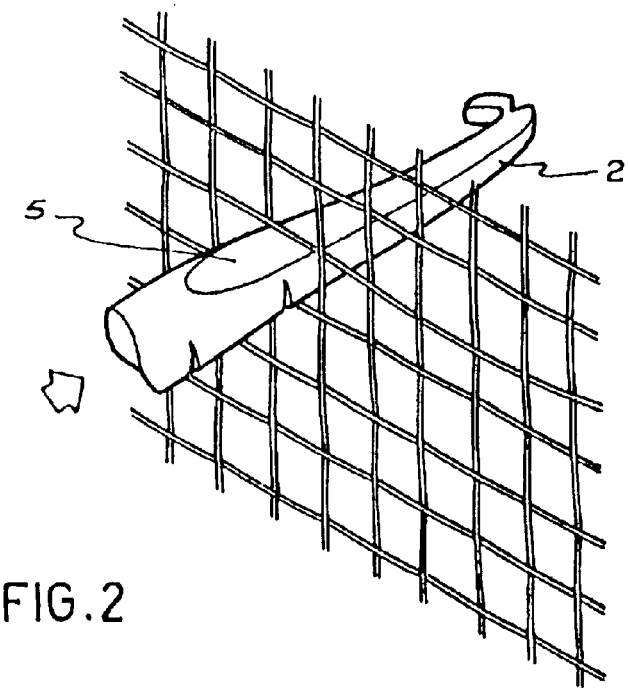
FIG. 2 is a view showing operation of the tool illustrated in FIG. 1 to calibrate string grid squares.

In an exemplary embodiment of the present invention, a narrowed grid square may be corrected as shown in FIG. 2. Introducing actuating point -2-, with a gradual push, using wedge -5- to provide the proper gap between the strings or a string and the frame, may make the correction.

Figure 3:
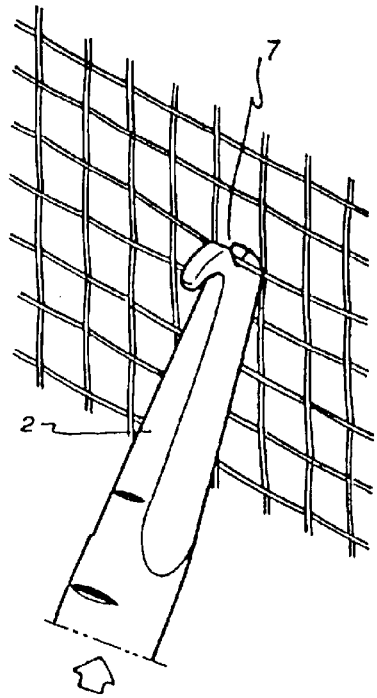
FIG. 3 shows a perspective view of the actuating point when pushing the string.

When the string is so tight that the corrective displacement, with reference to the perpendicular string to which it crosses, cannot be made, the player as shown in FIG. 3, may force the string into notch -7- and apply a pushing force in the necessary direction to reset the correct position.

Figure 4:
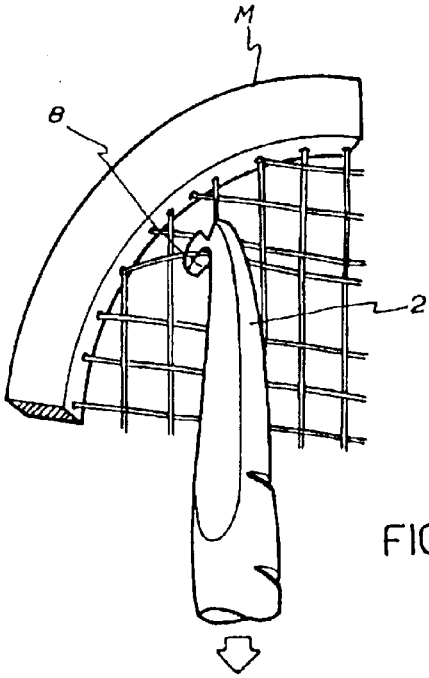
FIG. 4 is a view showing the tensile force exercised on the string.

FIG. 4 shows a racket section where the axial pushing force is impaired by a frame -M-. In this case, hook -8- is used to carry out the necessary correction while pulling from a comfortable position.

Figure 5:
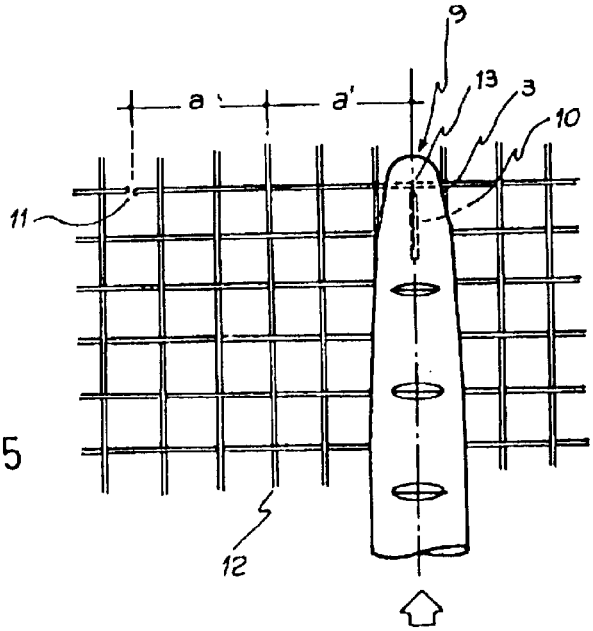
FIG. 5 shows a perspective view of the cutting point balancing a string section.

The strings shown in FIG. 5 have been accidentally cut at point -11- at an -a- distance from a central perpendicular string -12-, thus unbalancing the section tension. In this case, balance may be reestablished by a cut made at a point -13-, located at an -a'- distance from the center, by wedging the string into notch -9- and pushing until the string is cut by the cutting edge of blade -10-.

The racket string correcting tool that has been described and exemplified herein is included within the protection scope as determined, in the fundamental points, by the text of the following claims.

What is claimed is:

1. A racket string correction tool, capable of moving a displaced string using a notch and/or hook, and cutting a string to balance the tension of a string section at an off-centered point, wherein the notch, hook, and cutting device are combined in a single longitudinal body, said tool comprising a hilt, said hilt comprising a first end provided with an actuating point defined by a gradual reduction in its section, with two lateral faces distally converging as a wedge with a transversal notch to which the string may be forced and a lateral appendage that provides a hook, and a second end, which axially forms a cap including a cutting edge of a blade, assembled with a depth that exceeds, at least, the string half section.

2. A tool for adjusting placement and tension of racket strings, said tool comprising:

a hilt having a first portion and a second portion, wherein the first portion comprises an actuating end including a hook and two lateral faces distally converging as a wedge near the hook; and wherein a second portion includes a blade for cutting a racket string.

3. The tool of claim 2, further comprising grooves formed on the hilt.

4. A racket string aligning device having three tools combined in a single longitudinal body;

said device comprising a hilt;

said hilt comprising a first end having two lateral faces distally converging to form a wedge with a transverse notch in which a string may be forced and a lateral appendage that provides a hook; and said hilt further comprising a second end including a notch which houses a cutting edge.

5. A tool for aligning racket strings, said tool comprising:

a hilt having first and second opposing portions;

said first portion comprising a hook and two lateral faces distally converging to form a wedge adjacent to the hook; and said second portion comprising a blade for cutting the racket string.

* * * * *